US007017761B1

(12) United States Patent
Kneer

(10) Patent No.: US 7,017,761 B1
(45) Date of Patent: Mar. 28, 2006

(54) CONTAINER COMPRISING AN INNER POUCH

(75) Inventor: Roland Kneer, Farchant (DE)

(73) Assignee: Gaplast GmbH, Altenau (DE)

( * ) Notice: Subject to any disclaimer, the term of this patent is extended or adjusted under 35 U.S.C. 154(b) by 80 days.

(21) Appl. No.: 10/048,258

(22) PCT Filed: Jun. 7, 2000

(86) PCT No.: PCT/DE00/01849

§ 371 (c)(1),
(2), (4) Date: Apr. 26, 2002

(87) PCT Pub. No.: WO01/08990

PCT Pub. Date: Feb. 8, 2001

(30) Foreign Application Priority Data

Jul. 29, 1999 (DE) ..... 199 35 648

(51) Int. Cl.
*B65D 23/02* (2006.01)
*B65D 25/16* (2006.01)

(52) U.S. Cl. ..... 215/12.1; 215/3; 220/495.04; 220/661; 222/386.5

(58) Field of Classification Search ..... 215/3, 215/13.1, 12.1; 220/495.04, 661, 62.12, 220/62.18, 62.21, 62.22, 592.16, 386.15; 222/386.5

See application file for complete search history.

(56) References Cited

U.S. PATENT DOCUMENTS

| | | | | |
|---|---|---|---|---|
| 4,491,250 | A * | 1/1985 | Liebermann | 222/386.5 |
| 5,224,936 | A * | 7/1993 | Gallagher | 604/192 |
| 5,500,205 | A * | 3/1996 | Abbott et al. | 424/401 |
| 5,871,125 | A * | 2/1999 | Gross | 222/207 |
| 6,039,222 | A * | 3/2000 | Smith | 222/386 |
| 6,276,558 | B1 * | 8/2001 | Kneer | 220/661 |
| 6,343,713 | B1 * | 2/2002 | Abplanalp | 222/95 |
| 2001/0015359 | A1 * | 8/2001 | Benoist | |

* cited by examiner

*Primary Examiner*—Sue A. Weaver
(74) *Attorney, Agent, or Firm*—Pyle & Piontek

(57) ABSTRACT

A container comprises a substantially dimensionally stable outer wall and an easily deformable inner pouch which gradually contracts upon discharge of the contents of the container. As a result, pressure compensation is provided in the increasing space between the outer wall and the inner pouch. The outer wall and the inner pouch have, therebetween, a layer of a pressure compensating material that expands when acted upon by an agent. The expanding layer comprises, in an exemplary embodiment, citric acid and sodium bicarbonate foam acting against the inner pouch. The foamed pressure-compensating layer supports the inner pouch so that no vacuum is generated in the pouch.

8 Claims, 1 Drawing Sheet

CONTAINER COMPRISING AN INNER POUCH

CROSS-REFERENCE TO RELATED APPLICATIONS AND CLAIM TO PRIORITY

This application claims the benefit of and priority to PCT application no. PCT/DE00/01849, filed Jun. 7, 2000, the entire disclosure of which is incorporated herein by reference.

BACKGROUND OF THE INVENTION

The present invention relates to a container comprising a substantially dimensionally stable outer wall and an easily deformable inner pouch into which a pharmaceutical liquid can e.g. be filled that can be discharged with a pump attached to the neck of the container. However, the contents of the container may also be a cream or a past which is discharged from the opening of the container by compressing the outer wall.

The container may have the shape of a bottle or e.g. of a small tube, its shape being not limited in any way.

There are known containers consisting of a substantially dimensionally stable outer wall and an easily deformable inner pouch which are produced, for example, in a coextrusion type blow molding process and consist of two plastic layers that do not establish any connection with each other, i.e., the inner pouch which has first been inflated in contact with the dimensionally stable outer wall of the container detaches from the outer wall when the contents of the container are gradually discharged.

To enable the inner pouch to contract in accordance with the discharged volume, some kind of pressure compensation must take place between the outer wall of the container and the contracting inner pouch. To this end, pressure compensating holes through which air can enter into the space between the outer wall and the inner pouch are formed in the outer wall in the formerly known containers of the type in question.

Although a pressure compensation takes place through the holes in the outer wall, a negative pressure is often created in the inner pouch because a complete pressure compensation along the whole outer circumference of the inner pouch does not always take place and restoring forces are created by the contraction of the inner pouch, with the result that the inner pouch tries to return to its natural form to a certain extent.

The negative pressure prevailing in the inner pouch has, in turn, the consequence that air can enter into the inner pouch, either through fine opening in the wall of the inner pouch or, for example, due to leakage in the area of a possibly existing pump.

The entry of air into the inner pouch is highly undesired because this may deteriorate the quality of the contents of the container and because the liquid level in the inner pouch may fall to such an extent that part of the contents of the container can no longer be discharged, for instance because of the fact that the liquid level falls below the inlet opening of the suction tube of a pump.

BRIEF SUMMARY OF THE INVENTION

It is the object of the present invention to develop a container of the type in question in such a manner that pressure compensation takes place in a more advantageous way between the inner pouch which contracts upon discharge of the contents of the container and the substantially dimensionally stable outer wall.

In accordance with the present invention, the outer wall of the container and the inner pouch have arranged thereinbetween an expandable material which, upon discharge of filling material from the inner pouch, fills the increasing space between the outer wall and the inner pouch.

Preferably, the expandable material is positioned along substantially the whole space between the inner pouch and the outer wall, but it is also within the scope of the invention that the expandable material may only be disposed in some portions.

The outer wall and the inner pouch may be firmly connected to each other at individual places, which is preferably the case in the bottom area of the container, so that the inner pouch does not contract in axial direction, but definitely contracts in radial direction, which is of advantage to a complete discharge of the contents of the container. Suitably, outer wall and inner pouch are also firmly interconnected in the area of the container opening, i.e. e.g. on a container neck, so that an outwardly tight inner space is created between the outer wall and the inner pouch.

In a further development of the invention, the expandable material passes at least in part into a foam-like state upon the action of an agent. The foam-like expandable material fills the space created between the inner pouch and the outer wall upon the discharge of the contents of the container's inner pouch and the accompanying contraction of the inner pouch and the expandable material supports the inner pouch so that any negative pressure that might cause the entry of air into the inner pouch can virtually no longer be generated in the pouch.

As a rule, it is also possible that the expandable material gradually passes in part into an unfoamed, purely gaseous state upon the action of a suitable agent, thereby filling the space between outer wall and inner pouch. In such a case said space must be sealed hermetically to the outside.

In a further development of the invention, the agent which makes the pressure compensating material expand may be a substance which comes into contact with the expandable material.

The agent/substance may be water or water vapor which induces a pressure compensating layer to foam or expand if the layer (preferably) comprises citric acid and sodium bicarbonate. This is an advantageous development of the invention, and it should here be explicitly pointed out that said development is not limited to the indicated expandable material and the substance water or water vapor which causes the foaming process.

When water vapor is used as and agent for expanding the intermediate layer between outer wall and inner pouch, the water vapor preferably passes through the inner pouch according to a further proposal of the invention. To this end, the inner pouch consists of a material which is permeable to water vapor to a predetermined degree. For instance, very fine pores may be provided which, although they are permeable to water vapor, are not permeable to the remaining components of the contents of the container.

The agent for initiating the expansion of the pressure compensating layer can also act form the outside on the container or can be introduced through the outer wall into the intermediate space. One possible example is that that UV radiation impinges through the outer wall of the expandable material. Such UV radiation can, e.g., take place at a radiation station provided for said purpose after the container has been filled, and lead to an expansion in the intermediate space, and a negative pressure may be generated there by the contracting pouch.

As for the method of producing the container according to the invention, there are no restrictions. For instance, the container can be produced in a coextrusion type blow molding process from three layers—one layer for the inner pouch, one intermediate layer of expandable material, and one layer for the outer wall. The outer wall and the inner pouch can also be produced separately, the expandable material being applicable as a layer to the inner pouch or internally to the outer container. It is also not necessary that the outer container consists of plastics. A metal sheet may e.g. also be used as the material for the outer container.

The invention shall be described in more detail with reference to an embodiment shown in the drawings in which like numerals identify like components.

DETAILED DESCRIPTION OF A PREFERRED EMBODIMENT

The container shown in the FIGS. 1–4 is produced in a coextrusion type blow molding process from a three-layered tubular blank. The outer layer 1 consists of a relatively rigid plastic material so that said outer wall of the container substantially maintains its dimensional stability even if the contents of the container are discharged. The intermediate layer 2 comprises a mixture of citric acid and sodium bicarbonate, while the inner pouch 3 consists of a non-rigid plastic material.

Figure 1:
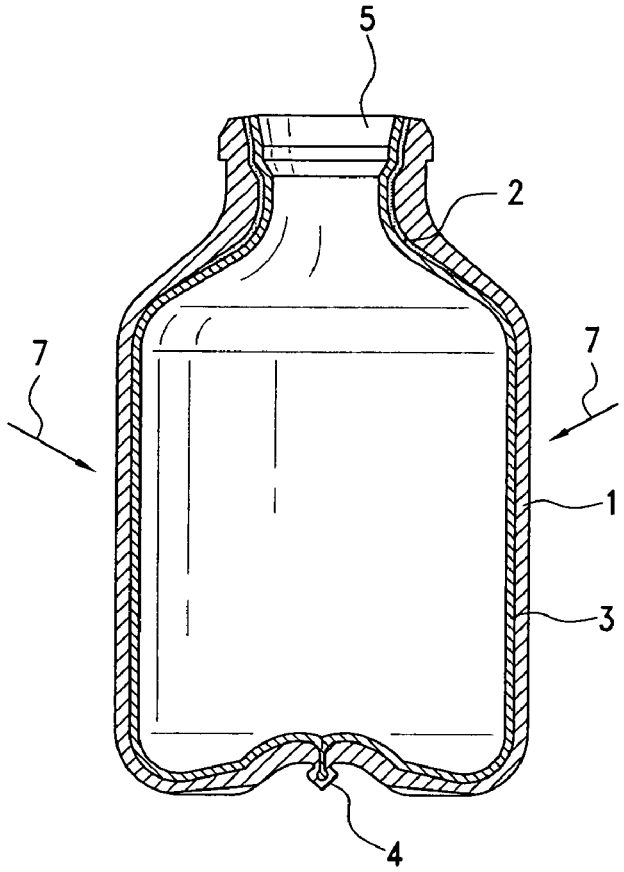
FIG. 1 is a vertical section through a container, in accordance with the present invention.
Figure 3:
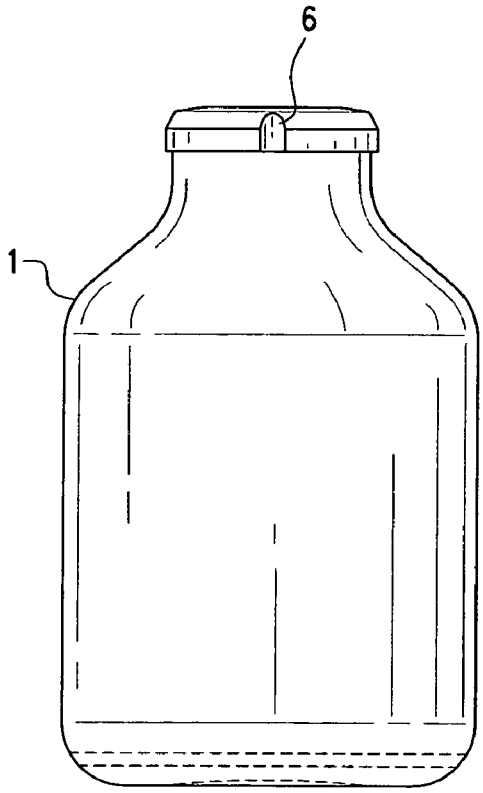
FIG. 3 is a side view of the container of FIGS. 1 and 2, in accordance with the present invention.
Figure 2:
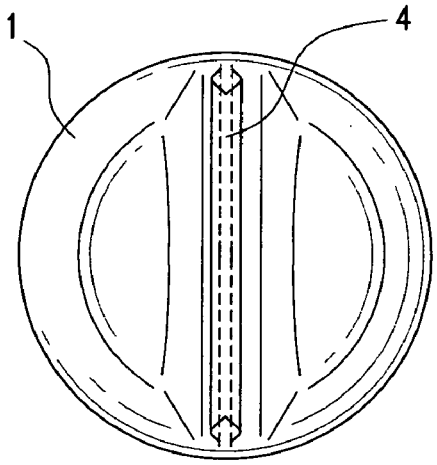
FIG. 2 is a bottom view of the container of FIG. 1, in accordance with the present invention.
Figure 4:
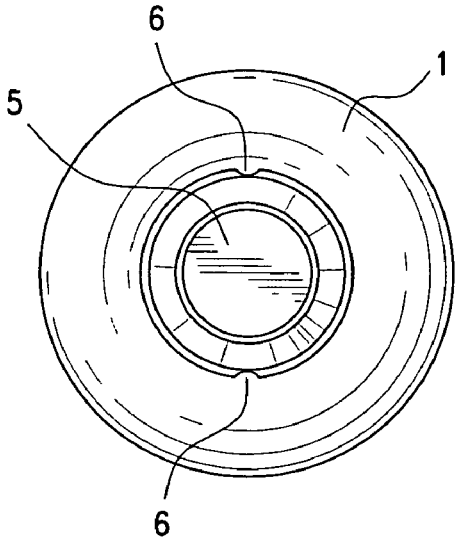
FIG. 4 is a top view on the container of FIGS. 1–3, in accordance with the present invention.

On the bottom, as shown in FIGS. 1 and 2, the mold cavity of the blow mold is designed such that when the blow mold is closed a pinch-off seam 4 of a substantially diamond-shaped cross section is created in which inner pouch 3 is clamped, as shown, partially, in FIG. 1. The squeezing in of inner pouch 3 has the effect that inner pouch 3 cannot contract in axial direction In the area of the opening 5 of the container, two vent beads 6 are formed in the outer wall 1. The vent beads prevent air from being entrapped during mounting of a bottom part of the pump. Vent beads 6 do not communicate with the space between the outer wall 1 and the inner pouch 3.

The container is intended to receive a substance which contains water. The inner pouch 3 is permeable to water vapor to a predetermined degree, the water vapor initiating the expansion of layer 2 after having passed through the wall of the inner pouch. A material foam is gradually formed between the wall 1 and the inner pouch 3, the foam filling the space between the two layers upon discharge of the filling substance, thereby supporting the inner pouch 3 in such a way that no negative pressure can be generated therein.

As noted above, the agent for initiating the expansion of the pressure compensating layer 2 can also act from the outside of the container or can be introduced through the outer wall 1 into the intermediate space. One possible example is that that UV radiation 7 impinges through outer wall 1 of the expandable material. Such UV radiation can, e.g., take place at a radiation station (not shown) provided for that purpose after the container inner pouch 3 has been filled, and lead to an expansion in the intermediate space, and a negative pressure may be generated there by the contracting pouch 3.

As for the method of producing the container according to the invention, there are no restrictions. For instance, as noted above, the container can be produced in a coextrusion type blow molding process from three layers—one layer for the inner pouch 3, one intermediate layer of expandable material 2, and one layer for the outer wall 1. The outer wall 1 and the inner pouch 3 can also be produced separately, the expandable material 2 being applicable as a layer to the inner pouch 3 or internally to the outer container 1. It is also not necessary that the outer container 1 consists of a plastic. A metal sheet may, for example, also be used as the material for the outer container 1.

This description is exemplary and is not intended to be limiting, since persons of skill in the art will recognize other embodiments falling within the scope of the present invention, as set forth in the following claims

What is claimed is:

1. A container comprising a substantially dimensionally stable outer wall and an easily deformable inner pouch, including an expandable material which, upon action of an agent gradually passes into a foam-like or gaseous state and fills the space created between said inner pouch and said outer wall upon discharge of filing material from said inner pouch, characterized in that said expandable material (2) is arranged between said outer wall (1) and said inner pouch (3), and that said agent passes through the wall of said inner pouch or the dimensionally stable outer wall to said expandable material (2); and wherein said filing material is not mixed with said expandable material.

2. The container according to claim 1, characterized in that upon action of said agent, said expandable material passes at least in part into a foam-like state.

3. The container according to claim 1, characterized in that said agent is a substance which comes into contact with said expandable material.

4. The container according to claim 3, characterized in that said substance is water vapor or water.

5. The container according to claim 1, characterized in that said expandable material comprises citric acid and sodium bicarbonate.

6. The container according claim 1, characterized in that said inner pouch consists of a material which is permeable to water vapor to a predetermined degree.

7. The container according to claim 1, characterized in that said container is produced in a coextrusion type blow molding process.

8. The container according to claim 1, characterized in that expandable material is applied as a layer to said inner pouch or internally to said wall of said container.

* * * * *